United States Patent [19]

Asanae et al.

[11] Patent Number: 4,529,680

[45] Date of Patent: Jul. 16, 1985

[54] MAGNETIC TONER FOR PRESSURE FIXATION

[75] Inventors: Masumi Asanae, Kumagaya; Koji Noguchi, Saitama; Hideyuki Itoi, Hiroshima; Katsumi Funakoshi, Kawasaki, all of Japan

[73] Assignees: Hitachi Metals, Ltd.; Mitsui Petrochemical Industries, Ltd., both of Tokyo, Japan

[21] Appl. No.: 563,763

[22] Filed: Dec. 21, 1983

[30] Foreign Application Priority Data

Dec. 22, 1982 [JP] Japan ..... 57-225434

[51] Int. Cl.[3] ..... G03G 9/14; G03G 9/08

[52] U.S. Cl. ..... 430/106.6; 430/109; 430/903; 524/431; 524/435; 252/62.54

[58] Field of Search ..... 430/106.6, 109, 903; 524/431, 435; 252/62.54

[56] References Cited

U.S. PATENT DOCUMENTS 4,265,992 5/1981 Kouchi et al. ..... 430/106.6

FOREIGN PATENT DOCUMENTS 53-45528 4/1978 Japan ..... 430/106.6

54-48556 4/1979 Japan ..... 430/106.6

*Primary Examiner*—Roland E. Martin

*Attorney, Agent, or Firm*—Finnegan, Henderson, Farabow, Garrett & Dunner

[57] ABSTRACT

A magnetic toner for pressure fixation containing at least a resin and a magnetic powder as the main components, where the resin is a polymer essentially, containing methyl-1-pentene as the main component and having a softening point of at least 80° C. and a compression yield strength of not more than 150 kg/cm$^2$, has a good fixability under a low pressure and a good preservability at a high temperature.

15 Claims, No Drawings

MAGNETIC TONER FOR PRESSURE FIXATION

BACKGROUND OF THE INVENTION

This invention relates to a magnetic toner for pressure fixation which is applicable to the electrophotographic process, magnetic printing process, etc.

The well known copying process for the electrophotography comprises forming an electrostatic latent image on a photosensitizer of, for example, Se, ZnO, organophotoelectric conductor, etc., developing the latent image by a magnetic developer according to a magnetic brush process, transferring the developed image onto a transfer sheet of ordinary paper, etc., and fixing the image, thereby obtaining an ultimate image. The magnetic developer so far used in the copying process is a binary developer based on a powdery mixture of a magnetic carrier and a non-magnetic toner of a fixing resin containing a coloring pigment, dyestuff, etc. However, the binary developer requires a developing apparatus provided with a means for keeping a toner concentration in the developer constant, or a means for mixing the toner with the carrier uniformly, and thus the developing apparatus becomes larger in size and complicated. These are problems with the binary developer. Furthermore, carrier particles must be mixed with toner by stirring for a long time, so that a toner film is formed on the surface of carrier particle, resulting in lowering of triboelectric charge characteristics of carrier. Thus, the carrier must be exchanged periodically.

To solve these problems, it has been proposed to use, as a magnetic developer for developing an electrostatic image, a single component magnetic toner comprising the resin and magnetic powder as the main components without using any carrier particle, and this proposal has been practically used at first in a process for direct fixation after development, using a special recording paper such as a zinc oxide paper and an electrostatic recording paper, and then also in a process for electrophotographic copying including the said transfer step. Magnetic toners are used not only in the electrophotographic process and the copying process utilizing an electrostatic recording, but also in the magnetic recording process using a magnetic drum.

In the foregoing copying processes, a heat fixation in an oven or by heat rolls, a pressure fixation only by application of a pressure at the room temperature, etc. are known to fix toner images, and the pressure fixation has been more and more used owing to no preheating time, that is, possible quick start, less power consumption, etc.

Known toners for the pressure fixation include a toner comprising an aliphatic main component of, for example, wax, etc., admixed with a thermoplastic resin for modification (Japanese Patent Publication No. 44-9880), and also a capsule type toner for pressure fixation comprising a tacky resin as nuclei, as disclosed, for example, in Japanese Patent Application Kokai (Laid-open) No. 49-17739, a magnetic toner based on wax and ethylene-vinyl acetate copolymer as resin components, as disclosed in U.S. Pat. No. 3,925,219, and a magnetic toner based on resin components of a thermoreactive resin or epoxy resin and ethylene-vinyl acetate copolymer, as disclosed in Japanese Patent Application Kokai (Laid-open) No. 51-36947. Furthermore, a magnetic toner based on a resin obtained by modifying a waxy compound having a yield strength of 3–300 kg/cm$^2$ with an ethylene-vinyl acetate copolymer having a definite yield strength has been practically used, as disclosed in Japanese Patent Publication No. 54-3373.

A magnetic toner for pressure fixation must have a good fixability, a good preservability at a high temperature, a good offset resistance, etc., but the so far known toners have failed to satisfy all of these requirements. For example, the toner disclosed in Japanese Patent Publication No. 44-9880 requires a high pressure at the fixation and is liable to coagulate while preserved. Microcapsule-type toners require a complicated preparatory procedure and are not practical, further because toners having stable characteristics are hardly obtainable. The toners based on a resin obtained by modifying a wax with an ethylene-vinyl acetate copolymer are more practical owing to a better fixability, stabler preservability and better flowability, but are somewhat poor still in the preservability at a high temperature and adhesion to a photosensitizer owing to a poor compatibility of the wax to other resins.

SUMMARY OF THE INVENTION

The object of the present invention is to provide a magnetic toner for pressure fixation without any of the said disadvantages inherent in the prior art, and particularly with a better fixability under a low pressure and a better preservability at a high temperature.

The present magnetic toner for pressure fixation is characterized by comprising a resin of polymer essentially containing methyl-1-pentene as the main component and having a softening point of at least 80° C. and a compression yield strength of not more than 150 kg/cm$^2$, and a magnetic powder as the main components.

The present invention will be described below in detail.

Generally, resins can be classified in the following main groups subject to behaviors in a processing apparatus; the resin that undergoes elastic deformation, the resin that undergoes brittle rupture, and the resin that undergoes plastic deformation. For toners for pressure fixation, resins that undergo plastic deformation under a specific pressure (about 3–300 kg/cm$^2$) are selected therefrom. Specifically, waxes such as polyethylene wax, polyolefin wax, amide wax, etc. are used for the toners, and the waxes having a higher softening point (above about 90° C.) have a good preservability but have no satisfactory fixability or require a higher pressure for the fixation owing to the high compression yield strength. On the other hand, waxes having a lower softening point have a good fixability owing to the low compression yield strength, but has a problem in the preservability at a high temperature. Thus, the ordinary waxes are usually mixed with other resins and used, but there are various inconveniences due to a poor compatibility of the waxes with other resins, as mentioned above.

As a result of extensive studies, the present inventors have found that a good magnetic toner for pressure fixation can be obtained by using a polymer essentially containing methyl-1-pentene as the main component and having a softening point of at least 80° C. and a compression yield strength of not more than 150 kg/cm$^2$, which belongs to the category of polyolefin, as a toner resin.

Polymers essentially containing methyl-1-pentene as the main component for use in the present invention may be a homopolymer of methyl-1-pentene or copolymers of methyl-1-pentene with other α-olefin components. The methyl-1-pentene for the polymer includes, for example, 4-methyl-1-pentene, 3-methyl-1-pentene, etc., and can be used alone or in mixture thereof. The α-olefins as the copolymer component include, for example, ethylene, propylene, 1-butene, isobutene, 1-pentene, 2-methyl-1-butene, 3-methyl-1-butene, 1-hexene, 3-methyl-1-hexene, 4-methyl-1-hexene, 1-heptene, 1-octene, 1-decene, 1-dodecene, 1-tetradocene, 1-hexadecene, 1-octadecene, etc., or a mixture thereof. The content of α-olefins in the copolymer is not more than 30% by weight, preferably not more than 20% by weight. The intrinsic viscosity of the polymer is in a range of 0.005 to 0.5 dl/g, preferably 0.01 to 0.3 dl/g, and the melting point of the polymer is in a range of 150° to 240° C., preferably 180° to 230° C. The polymer can be obtained according to a process for polymerizing methyl-1-pentene, or methyl-1-pentene and the said α-olefin in the presence of a stereospecific catalyst, or according to a process for radical degradation or thermal degradation of the thus obtained polymer.

It is essential that the softening point of the polymer essentially containing the methyl-1-pentene for use in the present invention is at least 80° C., preferably 90° to 160° C. Below a soften point of 80° C., the preservability at a high temperature becomes poor.

It is also essential that the compression yield strength of the polymer is not more than 150 kg/cm$^2$, preferably 30 to 120 kg/cm$^2$. Above a compression yield strength of 150 kg/cm$^2$, the fixability of magnetic toner becomes poor.

Physical properties of the polymer essentially containing methyl-1-pentene for use in the present invention are determined according to the following procedures:

(1) Softening point is determined according to a constant load penetration method (TMA method). That is, the polymer is formed into a 1 mm-thick sheet by compression molding, and a small piece (3 mm×3 mm) of the sheet is placed in a Du Pont thermal mechanical analyzer and subjected to heating from room temperature at a rate of 5° C./min under a needle load of 49 g to measure the temperature when the needle penetrates the sheet by 0.1 mm deep.

(2) Compression yield strength

A melt molding of the polymer is prepared into a square sample (10 mm×10 mm×10 mm) by cutting and the sample is subjected to deformation at a compression deforming rate of 2 mm/min by an Instron compression jig to measure the compression yield strength.

(3) Intrinsic viscosity [η] is measured in decalin solvent.

(4) Melting point is measured by a scanning differential calorimeter (CSC, Du Pont type 990).

The present magnetic toner contains magnetic powder as the essential component together with the said resin. The magnetic powder for use in the present invention includes, various ferromagnetic materials, for example, metals such as iron, nickel, chromium, cobalt, etc., their alloys, iron oxides such as ferrite, hematite, magnetite, etc. The magnetic powder for use in the toner particles must have an average particle size of 0.1-3 μm, preferably 0.5-1 μm. Among the magnetic powders enumerated above, magnetite ($Fe_3O_4$) is preferable from the viewpoints of magnetic characteristics and the color phase. The magnetic characteristics of a toner depends upon the kind and content of magnetic powder. The lower the coercive force, the more readily the toners coagulate one another, whereas with too high a coercive force, the content of acicular particles is increased and thus the volume of magnetite is increased. Thus, magnetite having an IHC of 80-400 Oe, preferably 160-300 Oe is usually used.

The saturation magnetization (Os) of a toner depends upon the magnetic powder. With too low a saturation magnetization, the transferability on a magnetic roll is lowered, whereas with too high a saturation magnetization, the fixability is lowered. Thus, the saturation magnetization is adjusted to 50-65 emu/g. Many commercially available magnetites have IHCs of approximately 100 Oe, 200 Oe and 400 Oe. Thus, to obtain an intermediate IHC therebetween, two kinds of magnetites may be mixed and used. The content of the magnetic powder is selected from a range of 30-80% by weight on the basis of total weight of toner. With too low a content of magnetic powder, the toner is liable to be scattered off from the magnet roll, whereas with too high a content of magnetic powder, the fixability is lowered.

The present magnetic toner can contain at least one of a color-controlling pigment, a charge-controlling agent, a resistance-controlling agent, a dry lubricating powder, etc. The color-controlling pigment for use in the present invention includes, for example, black pigments, such as carbon black, lamp black, anilin black, etc. The charge-controlling agent includes, for example, dyestuffs with a positive triboelectric chargeability, such as nicrosine dyestuff, and nicrosine dyestuff modified with a higher fatty acid, and dyestuffs with a negative triboelectric chargeability such as metal (Cr)-containing azo dyestuff, etc. the resistance-controlling agent includes, for example, fine electroconductive particles such as carbon black. The dry lubricating powder includes usually used $SiO_2$ particles. $SiO_2$ has a polarity and thus is effective for giving the toner a negative chargeability. Carbon black can have various functional groups, depending upon processes for producing carbon black, and can be used as a charge-controlling agent. The total amount of the said additives is preferably not more than 10% by weight on the basis of the total weight of toner.

The present magnetic toner can be prepared from the said materials according to the well known process. That is, according to the so called pulverization process the raw materials are permixed, kneaded with heating, solidified by cooling, and pulverized. The resulting powders are spherized, and if necessary admixed with carbon black, and classified. According to the so called spray drying process, magnetic powder is dispersed in an organic solvent solution of resin, and the dispersion is spray dried. Then, the resulting powders are classified.

The present magnetic toner can be applied to the so called CPC process of direct fixation after the development or to a PPC process including a transfer step. In the case of CPC process, the resistance of toner is preferably not more than $10^{11}$ Ω.cm, and in the case of PPC process, the resistance of toner is preferably at least $10^{12}$ Ω.cm from the viewpoint of transferability, and particularly when the ordinary paper having a volume resistance of not more than $10^{12}$ Ω.cm is used as transfer paper. The resistance is preferably at least $10^{14}$ Ω.cm. The resistance is determined by filling a toner in a polyacetal cylinder with the inner diameter of 3.05 mm to a height of 10-20 mm and measuring the resistance in an DC field of 4,000 V/cm under the load of 100 g.

Particle sizes of toner is in a range of 5-50 μm, and particularly 10-30 μm for the PPC process.

PREFERRED EMBODIMENTS OF THE INVENTION

EXAMPLE 1

4-Methyl-1-pentene-1-decene copolymer containing 3% by weight of 1-decene and having an intrinsic viscosity [η] of 3.28 dl/g, which was prepared by copolymerizing 4-methyl-1-pentene and 1-decene in the presence of a stereospecific catalyst, was thermally decomposed at the temperature of 350° C. in a nitrogen atmosphere for 2 hours to obtain 4-methyl-pentene low molecular weight polymer having an intrinsic viscosity [η] of 0.14 dl/g, a melting point of 207° C., softening point of 113° C. and a compression yield strength of 85 kg/cm$^2$.

50 Parts by weight of the thus obtained 4-methyl-1-pentene polymer and 50 parts by weight of magnetite (EPT 1000 made by Toda Kogyo K.K., Japan) were dry premixed, then kneaded under melting at a temperature of about 200° C. in a heated kneader, and then solidified by cooling. Then, the cooled solidified product was finely pulverized in a jet mill, and the powders were classified to obtain a magnetic toner having particle sizes of 10–30 μm.

EXAMPLE 2

4-Methyl-1-pentene.1-hexadecene.1-octadecene copolymer containing 6.5% by weight of 1-hexadecene and 1-octadecene in total and having an intrinsic viscosity [η] of 3.42 dl/g, which was produced by copolymerizing 4-methyl-1-pentene, 1-hexadecene and 1-octadecene in the presence of a stereospecific catalyst was thermally decomposed at a temperature of 350° C. in a nitrogen atmosphere for 2.5 hours to obtain 4-methyl-1-pentene low molecular weight polymer having an intrinsic viscosity [η] of 0.11 dl/g, a melting point of 190° C., a softening point of 93° C. and a compression yield strength of 68 kg/cm$^2$.

A magnetic toner was prepared from the thus obtained 4-methyl-1-pentene polymer in place of the polymer of Example 1 in the same manner as in Example 1.

EXAMPLE 3

A magnetic toner was prepared from 40 parts by weight of the 4-methyl-1-pentene polymer of Example 1 in place of 50 parts thereof in the same manner as in Example 1.

EXAMPLE 4

A magnetic toner was prepared from 60 parts by weight of the 4-methyl-1-pentene polymer of Example 1 in place of 50 parts by weight thereof in the same manner as in Example 1.

EXAMPLE 5

A magnetic toner was prepared from 40 parts of the 4-methyl-1-pentene polymer of Example 2 in place of 50 parts by weight thereof in the same manner as in Example 1.

EXAMPLE 6

A magnetic toner was prepared from 60 parts by weight of the 4-methyl-1-pentene polymer of Example 2 in place of 50 parts by weight thereof in the same manner as in Example 1.

COMPARATIVE EXAMPLE 1

A magnetic toner was prepared from a mixture of polyethylene wax (HIWAX 400 P having a molecular weight of about 4,000, made by Mitsui Petrochemical Industries, Ltd., Japan) and ethylene-vinyl acetate copolymer (ACP 400, made by Allied Chemical Corp., USA) in a ratio of 7:3 by weight in place of the 4-methyl-1-pentene polymer of Example 1 in the same manner as in Example 1.

COMPARATIVE EXAMPLE 2

A magnetic toner was prepared from polyethylene wax (HIWAX 110P having a molecular weight of about 1,000, made by Mitsui Petrochemical Industries, Ltd., Japan) in place of the 4-methyl-1-pentene polymer of Example 2 in the same manner as in Example 1.

Image evaluation of the magentic toners (all having a resistance of $10^{15}$ ω.cm) prepared in the foregoing Examples and Comparative Examples was made according to a commercially available electrophotographic copying machine (CP55, made by Kyoto Ceramic Co., Ltd., Japan), and preservability thereof was also tested by leaving the toners in covered glasses at 55° C. for 100 hours. Fixing was carried out between pressure rolls (steel rolls with hard chromium-plated surfaces) under the linear pressure of 18 kg/cm$^2$, and fixability was evaluated by applying a peeling test to full black images by a scotch tape, where a ratio of the copy density after peeling to that before peeling in percentage was measured.

Offset was evaluated by passing a white paper (copy paper having no toner image) through between fixing rolls after the fixation operation and visually observing foulings generated on the copy paper by the offset of toner.

Adhesion of toner to a photosensitizer was evaluated by visual observation of images after the fixation operation. When the successive copying is carried out while the toner remains attached to the photosensitizer, black spots are generated on the resulting copy. Thus, generation of black spots are to be visually observed. The results are given in the following Table.

TABLE

| | Image evaluation | | | |
|---|---|---|---|---|
| Toner | Fixability | Preserv-ability | Offset | Prevention of adhesion of toner to photo-sensitizer |
| Ex. 1 | 82% | Good | Good | Good |
| Ex. 2 | 89% | " | " | " |
| Ex. 3 | 87% | " | " | " |
| Ex. 4 | 78% | " | " | " |
| Ex. 5 | 93% | " | " | " |
| Ex. 6 | 82% | " | " | " |
| Comp. Ex. 1 | 42% | " | " | " |
| Comp. Ex. 2 | 88% | Poor | " | Poor |

As described above, the present magnetic toner has a good fixability under a low pressure and a good preservability at a high temperature and also a good offset and a good prevention of toner from adhesion to a photosensitizer, and thus can produce a pressure-fixed image of good quality.

What is claimed is:

1. A magnetic toner having a saturation magnetization of 50–65 emu/q for pressure fixation, which comprises a resin and a magnetic powder having an average particle size of 0.1–3 μm, the resin being a polymer, at least 70% by weight of said polymer being methyl-1-pentene, said polymer being the only polymer component in said toner, said polymer having a softening point of 80° C.–160° C. and a compression yield strength of not more than 150 kg/cm$^2$.

2. A magnetic toner according to claim 1, wherein the polymer is a homopolymer of methyl-1-pentene or copolymers of methyl-1-pentene and other α-olefins.

3. A magnetic toner according to claim 2, wherein the methyl-1-pentene is 4-methyl-1-pentene, or 3-methyl-1-pentene, or a mixture thereof.

4. A magnetic toner according to claim 2, wherein the α-olefins are ethylene, propylene, 1-butene, isobutene, 1-pentene, 2-methyl-1-butene, 5-methyl-1-butene, 1-hexene, 3-methyl-1-hexene, 1-methyl-1-hexene, 1-heptene, 1-octene, 1-decene, 1-dodecene, 1-tetradecene, 1-hexadecene, or 1-octadecene, or mixtures thereof.

5. A magnetic toner according to claim 2, wherein said polymer is a copolymer containing not more than 30% by weight of the other α-olefins.

6. A magnetic toner according to claim 1, wherein the polymer has an intrinsic viscosity [η] of 0.005–0.5 dl/g, and a melting point of 150°–240° C.

7. A magnetic toner according to claim 2, wherein the polymer is prepared by polymerization of methyl-1-pentene or by copolymerization of methyl-1-pentene and α-olefin in the presence of a stereospecific catalyst.

8. A magnetic toner according to claim 2, wherein the polymer is prepared by degradation of a polymer which is produced by polymerization of methyl-1-pentene or by copolymerization of methyl-1-pentene and α-olefin in the presence of a stereospecific catalyst.

9. A magnetic toner according to claim 8, wherein the degradation is carried out radically or thermally.

10. A magnetic toner according to claim 1, wherein the softening point is 90°–160° C., and the compression yield strength is 30–120 kg/cm$^2$.

11. A magnetic toner according to claim 1, wherein the magnetic powder is a ferromagnetic material.

12. A magnetic toner according to claim 11, wherein the ferromagnetic material is iron, nickel, chromium, cobalt or their alloys, ferrite, hematite or magnetite.

13. A magnetic toner according to claim 12, wherein the ferromagnetic material is magnetite having an IHC of 80–400 Oe.

14. A magnetic toner according to claim 1, wherein said toner also includes at least one additive which functions as a color-controlling pigment, a charge-controlling agent, a resistance-controlling agent, or a dry lubricating powder.

15. A magnetic toner according to claim 14, wherein said additive or additives comprise not more than 10% by weight of the total weight of the toner.

* * * * *